US005403015A

United States Patent [19]

Forte et al.

[11] Patent Number: 5,403,015

[45] Date of Patent: Apr. 4, 1995

[54] CARDS AND METHODS FOR PLAYING CASINO 21 OR BLACKJACK

[76] Inventors: Steven L. Forte, 7116 Abbeyville Dr., Las Vegas, Nev. 89119; Randy D. Sines, 4056 S. Madelia, Spokane, Wash. 99203

[21] Appl. No.: 165,302

[22] Filed: Dec. 9, 1993

[51] Int. Cl.[6] ..... A63F 1/00

[52] U.S. Cl. ..... 273/304; 273/292; 273/307

[58] Field of Search ..... 273/292, 309, 303–307; D21/45, 44, 42

[56] References Cited

U.S. PATENT DOCUMENTS

| | | | |
|---|---|---|---|
| D. 56,072 | 8/1920 | Loring | D21/44 |
| D. 85,407 | 10/1931 | Weintraub | D21/45 |
| D. 87,084 | 5/1932 | Schaeffer | D21/45 |
| D. 134,118 | 10/1942 | Demorest | D21/45 |
| D. 170,269 | 8/1953 | Nekuda | D21/42 |
| D. 195,634 | 7/1963 | Saxon | D21/45 |
| D. 222,782 | 12/1971 | Dibrell | D21/45 |
| D. 230,617 | 3/1974 | Ekstrand | 273/292 |
| 1,798,672 | 3/1931 | Hines | 273/296 |
| 2,639,922 | 5/1953 | Laycott | 273/306 |
| 4,014,549 | 3/1977 | Cywar | 273/304 |
| 5,039,102 | 8/1991 | Miller | 273/304 |
| 5,224,712 | 7/1993 | Laughlin et al. | 273/304 |

OTHER PUBLICATIONS

The Way To Play by The Diagram Group, pp. 80–81, Paddington Press Ltd., 1976.

*Primary Examiner*—Benjamin H. Layno

*Attorney, Agent, or Firm*—Wells, St. John, Roberts, Gregory & Matkin

[57] ABSTRACT

A playing card deck for playing blackjack or casino twenty-one. The cards preferably have diagonally opposing primary and secondary corners. All cards in the deck have indicia or markings at the primary corners which indicate the nature of the card (suit and card type). The deck has two groupings of cards. The secondary corners of the first group do not indicate the specific nature or count of the card. The secondary corners of the second group, such as aces, have secondary indicia. This allows a dealer to selectively peek at the secondary corner of his face-down card to determine whether a blackjack hand exists. If blackjack does not exist, then the dealer does not know the face-down card and cheating or unintentional disclosure is prevented.

15 Claims, 6 Drawing Sheets

CARDS AND METHODS FOR PLAYING CASINO 21 OR BLACKJACK

TECHNICAL FIELD

The technical field of this invention is card decks and methods of playing the casino card game alternatively called blackjack, casino twenty-one, or simply twenty-one. The methods and card decks provide increased protection for casinos against cheating and inadvertent disclosure by dealers.

BACKGROUND OF THE INVENTION

The card game twenty-one or blackjack is a very popular card game. It is particularly popular as a casino card game involving betting. In casinos the house typically holds the dealer hand. The basic object of the game is to obtain a combined card count which beats the count of the dealer without going over twenty-one. The game is played with a common card deck or multiple decks having fifty two cards in four suits. Each suit has an ace, numerically indexed cards from two to ten, and the face cards. The face cards are jacks, queens and kings.

In the play of blackjack the dealer initially deals two cards to each player and the dealer. The cards are dealt one at a time around the table. The initial two cards to the players are either dealt both facedown or both faceup, depending upon the rules of the particular blackjack table or casino involved.

The dealer receives one card faceup and the other initial card facedown. The faceup card is also called the "upcard". The face-down card is also called the "hole card". An initial wager is placed before dealing the first two cards in casino games. After the first two cards are dealt to all players, each player is offered a variety of options including: standing, hitting, splitting and doubling down. The player directs the dealer to deal zero, one or more additional cards to that particular player. Rules of betting and play vary from casino to casino. If the player's total hand count exceeds twenty-one, then the player loses and this is often called a "bust". If the player holds with cards which count a total of twenty-one or less, then he is still in and the next player makes similar decisions about betting and additional cards. The dealer plays last and is instructed by the house to hold when a certain count is achieved, typically 17 or higher.

If the dealer has a ten-count card and an ace after the first two cards, then the dealer wins. This hand is typically referred to as "blackjack" or "natural". The only exception to the dealer's winning blackjack hand, is when a player also has a blackjack hand. It is desirable to know after the first two cards are dealt whether the dealer has a blackjack and the hand can be ended. This is particularly important in casinos because playing the hand out requires time. Fully playing the hand reduces the total volume of gambling which occurs in a given time period. Thus, the casino industry has typically desired to have the dealer look at his hole card and then terminate play if there is a dealer blackjack.

Having the dealer complete play in this manner has some derogatory effects. If the dealer looks at the face-down card, then the dealer knows what his hand counts. This knowledge can be intentionally or unintentionally divulged by the dealer to the detriment of the house. The derogatory effect can occur because the other players may alter their betting and demands for additional cards if they have additional knowledge of the dealer's hole card. Divulgence by the dealer of his hand is most obviously a problem when the dealer is in complicity with a player in an effort to take advantage of the house. Such schemes have been previously tried and effected to the loss of the casino. Less obvious are instances where the dealer subconsciously divulges the count of the dealer's hand to other players. This can occur when a dealer reacts in a way which is indicative of an unfavorable or favorable card count after peeking at the hole card.

Because of these concerns, it is sometimes decided by casino owners or managers that the dealer will not look at the hole card until the hands of the other players have been played. However, this increases the playing time of the hand when the dealer has a blackjack hand. These considerations have resulted in a conundrum for casino owners and managers as to which is the best approach.

This problem has been previously addressed by a casino twenty-one system which utilizes a specially constructed table having an optical sensor. If the face up card is a ten-count card or ace, then the dealer scans the face-down card across the scanner. The face-up card is entered manually or automatically. Electronics determine whether the card is the card needed to provide a blackjack hand, without the dealer looking at the face of the card.

Other systems have been devised which use mirrors and prisms. These systems have the dealers position the hole card adjacent the mirrors or prisms for selective determination whether the hole card is the other member of a blackjack pair.

These approaches attempt to prevent the dealer from looking at the face-down or hole card. This prevents the dealer from consciously or subconsciously divulging the hand. If the dealer's hand is a blackjack, then play of the hand is ended, and time is saved. The saved time translates into increased revenues for the casino because a larger volume of gambling can occur within the operating hours available.

BRIEF DESCRIPTION OF THE DRAWINGS

One or more preferred forms of the invention are described herein with reference to the accompanying drawings. The drawings are briefly described below.

FIG. 4 is a face view of the seven of diamonds card of a preferred card deck according to this invention.

FIG. 5 is a face view of the ten of diamonds card of a preferred card deck according to this invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
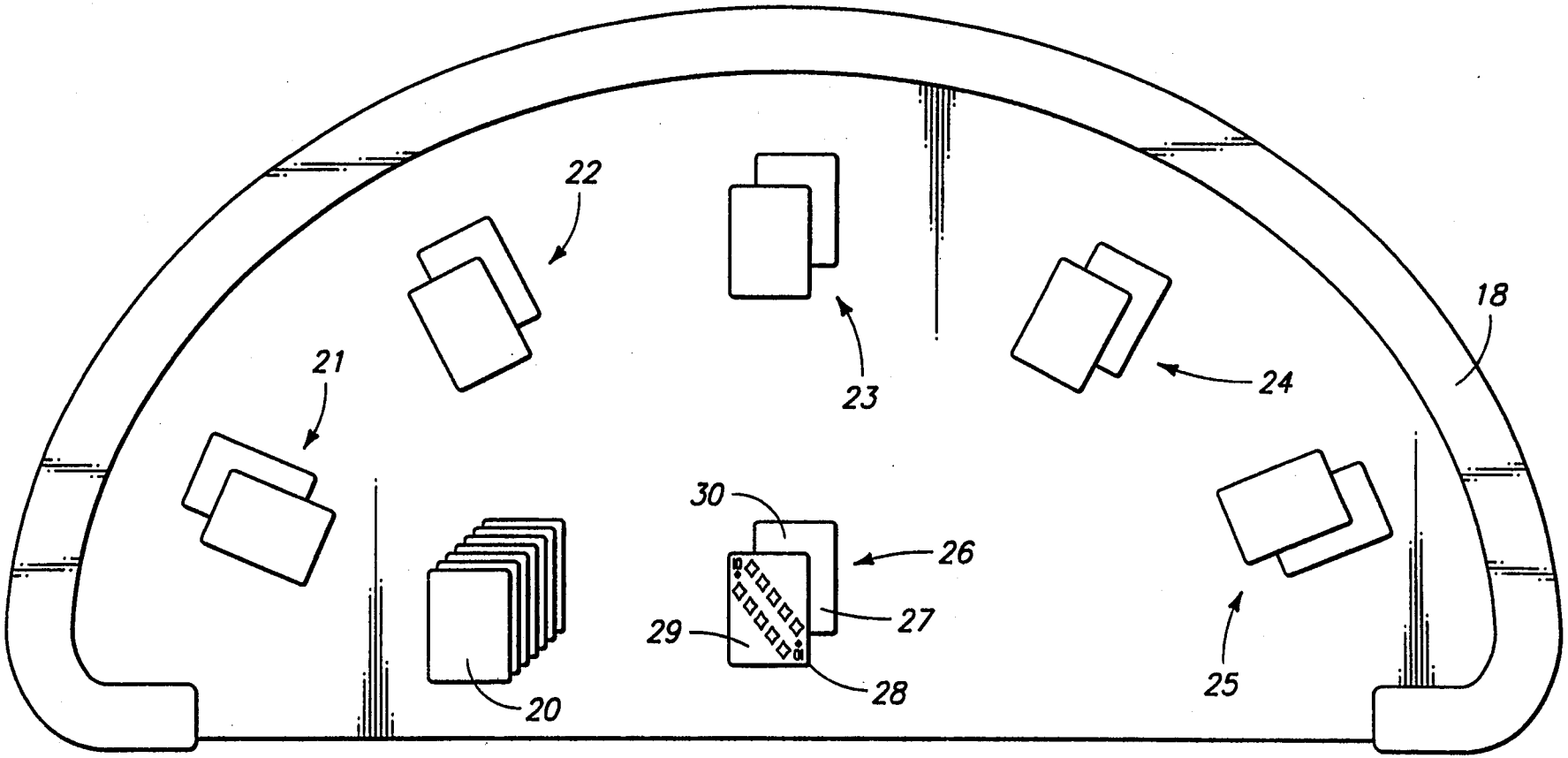
FIG. 1 is an overhead or plan view showing the top of a blackjack table with player and dealer hands thereon.

FIG. 1 shows a blackjack table 18 equipped with a novel deck of cards 20 made in accordance with this invention. The deck of cards 20 has been partially dealt to produce the initial, two-card hands for five players and a dealer. The first, second, third, fourth, and fifth player hands are identified by the reference numerals 21–25, respectively. The dealer's hand is identified by the reference numeral 26. All player hands are dealt with two face-down cards. The dealer has one face-down card and one face-up card. Each card has a front or face side 29 and a back side 30. The face side is marked with card-specific information indicating the particular card.

The dealer's hand includes face-down or hole card 27, and face-up card or upcard 28. Since the face-up card is a ten card, it is possible for the dealer to have a blackjack hand if the face-down card 27 is an ace. A "blackjack hand", or more simply a "blackjack" is a combination of a ten-count card and an ace.

If the casino policy is for the dealer to peek at the face-down card to determine whether there is a blackjack, then there is an increased risk of cheating or inadvertent disclosure of the dealer's hand. This increased risk occurs because the dealer knows his hand and can communicate some indication of it to an accomplice player in ways that are hard to detect or prove.

If the casino policy is to not peek at the face-down card, then all five hands of the players must be played out before the dealer reveals his winning blackjack. However, this wastes time. Thus, it is desirous that the dealer be able to determine whether he holds a blackjack in a selective or limited way not indicating the specific nature of the face-down card unless there is a blackjack. This is called selective determination of dealer blackjack. More specifically, in a preferred embodiment described herein there is selective determination of whether the face-down dealer card is an ace which pairs with a face-up ten-count card to provide a blackjack. This is done by limited visual examination of the face-down card of a special and novel card deck according to this invention. The novel cards of deck 20 allow the dealer to selectively determine whether the face-down card is an ace, but without learning the specific nature of the face-down card if it is not an ace.

Figure 2:
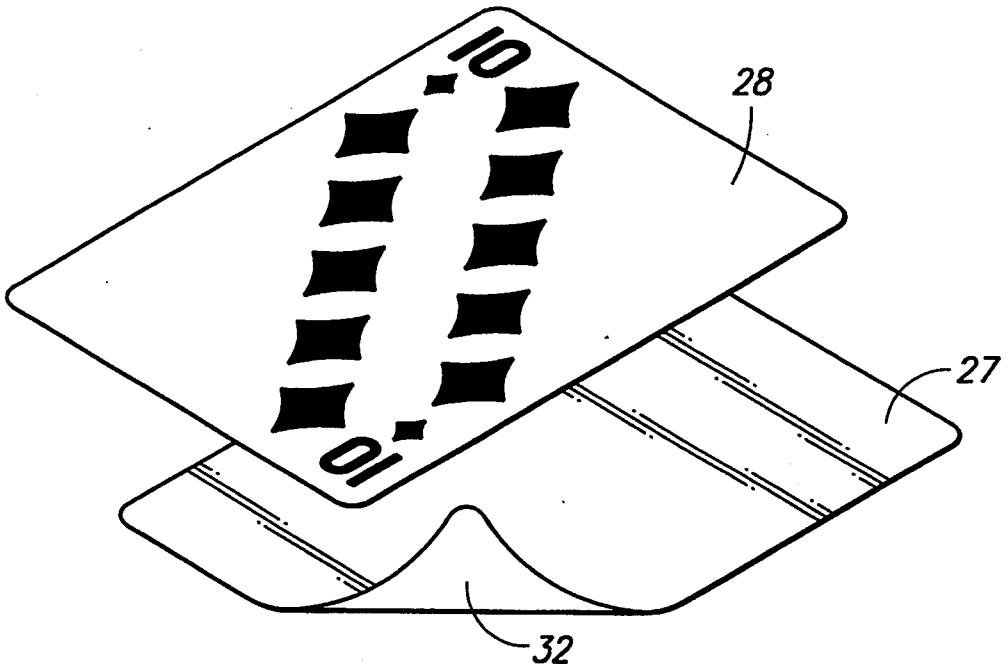
FIG. 2 is a perspective view showing the dealer's hand from FIG. 1 with the dealer peeking at the secondary corner of the face-down card. The face-down card is not an ace so the dealer does not determine the nature of the card.

FIG. 2 illustrates a peek by the dealer at a secondary corner 32 of the face-down card 27. Face-down card 27 is constructed and used in accordance with the novel concepts of this invention. As shown in FIG. 2, the face-down card is not an ace and the secondary corner 32 does not indicate the specific nature of the card or otherwise distinguish it from other non-ace cards. By specific nature of a card it is meant the suit and character of the card, such as whether it is a two of spades or jack of hearts. With the information available from the secondary corner 32 as shown in FIG. 2, the dealer is unable to determine the specific nature of the face-down card. The dealer is also unable to indicate the count of the dealer's hand, such as to an accomplice. All players will equally know that blackjack does not exist in the dealer hand of FIG. 2 because the dealer would, after peeking, otherwise indicate he holds a blackjack and immediately close play of that hand.

Figure 3:
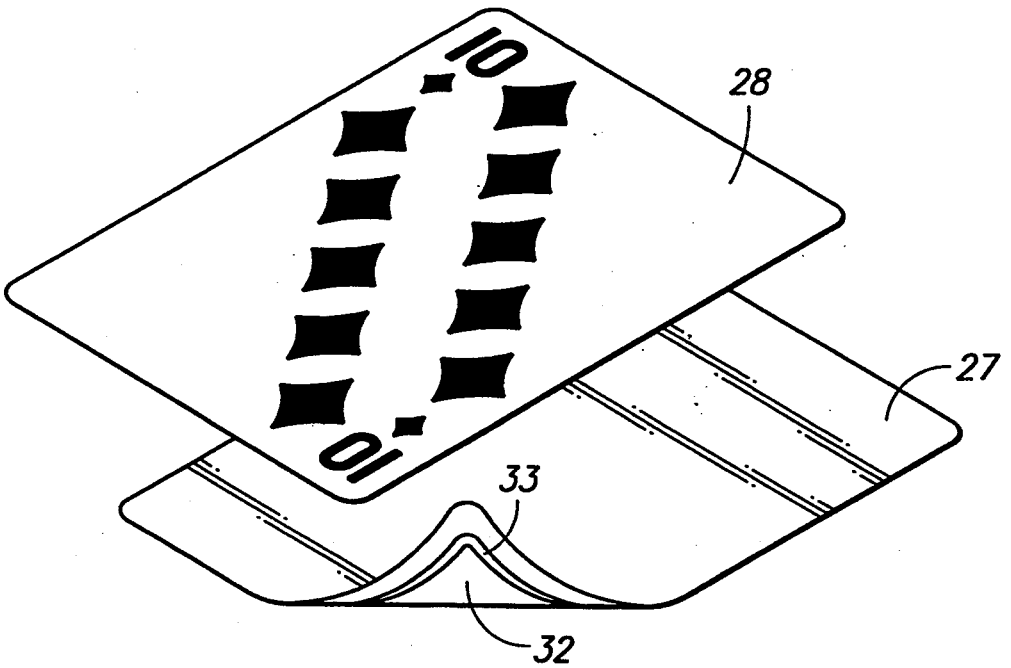
FIG. 3 is an alternative perspective view showing the dealer's hand of FIG. 1 with the dealer peeking at the secondary corner of the face-down card. The face-down card is an ace as indicated by the double perimeter line in the secondary corner.

FIG. 3 shows an alternative possibility for dealer hand 26. In FIG. 3 the face-down card 27 is an ace. The ace is indicated by a distinctive secondary indicator. More specifically, card 27 of FIG. 3 has a secondary corner ace indicator. As shown, this secondary corner ace indicator is in the form of a double line 33 at or near the perimeter of the secondary corner. With the dealer hand pictured in FIG. 3, the dealer is able to peek at the secondary corner and determine that a blackjack exists. However, the determination is made without learning the specific nature of the face-down card if it is a non-ace.

FIGS. 4–7 show exemplary cards from deck 20 made according to the novel concepts of this invention. FIG. 4 shows the face 29 of a seven of diamonds card 40. The face is rectangular and has a pair of diagonally opposing primary corners 41. The face of the card contains card-specific indicia which indicate the specific nature of the card. The card-specific indicia include a character indicator 43, which as shown is the arabic numeral "7". Below or inward from the character indicator 43 is a suit or other class indicator 44. The card specific indicia for card 40 further includes a series of pips 45. Pips 45 are seven in number to additionally indicate the character of the card.

Novel cards made according to this invention preferably have primary card-specific indicia arranged and positioned on the face of the card so as to not extend into the secondary corners 42. The secondary corners are preferably diagonally opposing corners which are in juxtaposition to the diagonally opposing primary corners 41. This exclusion of card-specific indicia from the secondary corners of most cards in the deck is important in the inventive cards and methods of play developed by the inventors.

FIG. 5 shows another exemplary card 50 included in a novel deck of cards 20 made in accordance with this invention. Card 50 has diagonally opposing primary corners 51 and secondary corners 52. The face of card 50 also has card-specific primary indicia indicating the specific nature of the card as being a ten of diamonds. The card-specific primary indicia is contained within a diagonal band extending between the opposing primary corners 51. The diagonal band of card-specific indicia includes numerical character indicators 53, which are the arabic numerals "10"; the suit indicators 54; and the ten diamond-shaped pips 55. The secondary corners 52 are non-distinctive as compared to other secondary corners of all non-ace cards in deck 20. As shown, the non-distinctive secondary corners are plain without markings of any type. Alternatively the non-ace cards could have an affirmative marking or markings which are not distinctive, for example similar designs.

Figure 6:
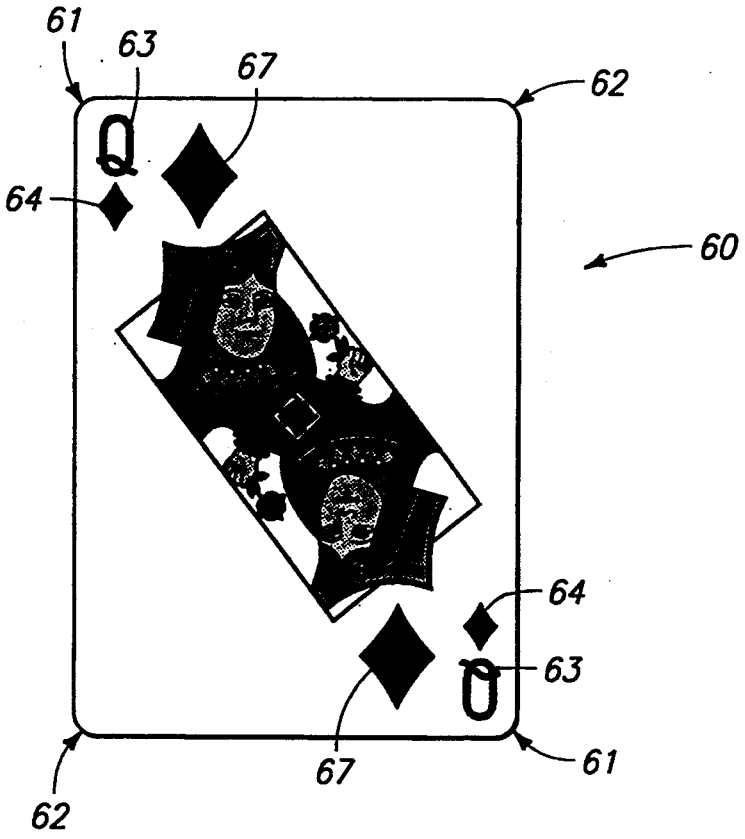
FIG. 6 is a face view of the queen of diamonds card of a preferred card deck according to this invention.

FIG. 6 shows another exemplary card 60 taken from the novel deck 20. Card 60 is the queen of diamonds. Card 60 is a face card having a count or value of ten. The face of card 60 has card-specific primary indicia indicating the specific nature of the card as the queen of diamonds. The card-specific indicia is contained within a diagonal band extending between the opposing primary corners 61. The diagonal band of card-specific indicia includes alphabetical character indicators 63, which are the letters "Q"; the suit indicators 64; and two additional diamond-shaped pips 67. The secondary corners 62 are non-distinctive as compared to other secondary corners of all non-ace cards in deck 20. As shown, the non-distinctive secondary corners are plain without markings of any type.

Figure 7:
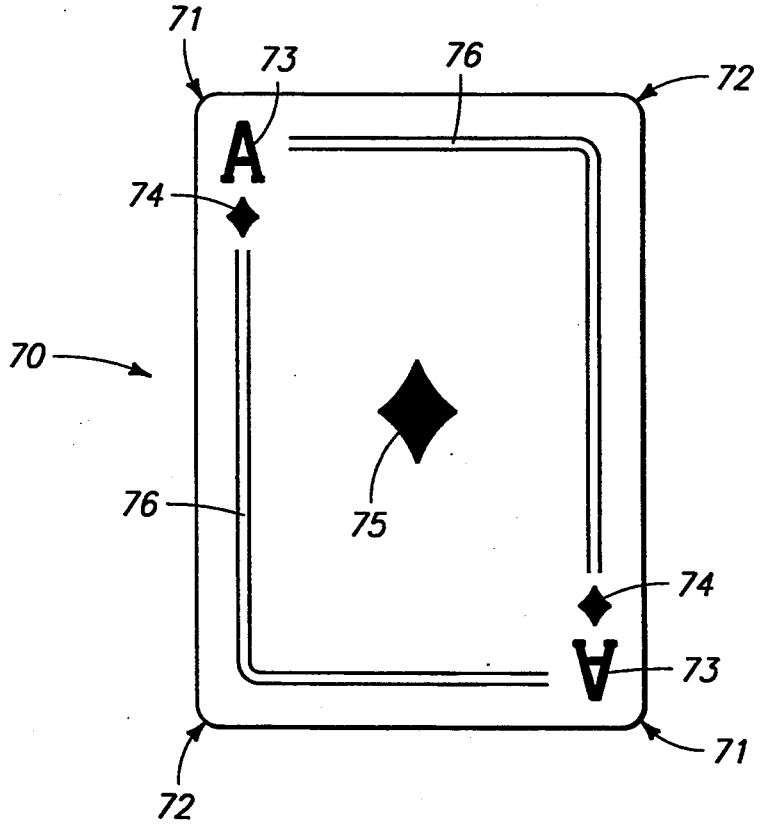
FIG. 7 is a face view of the ace of diamonds card of a preferred card deck according to this invention.
Figure 6:
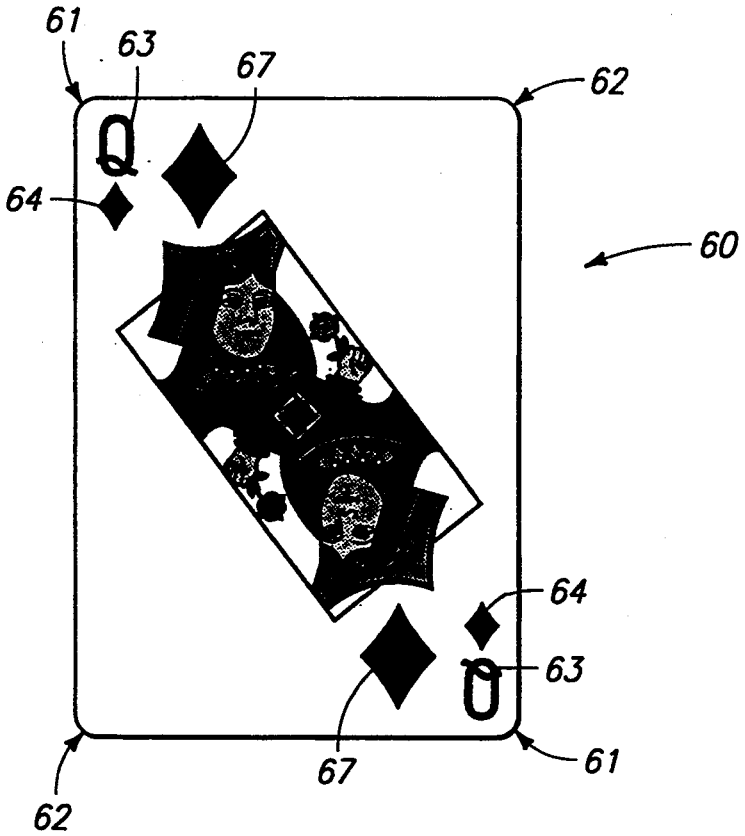
Figure 7:
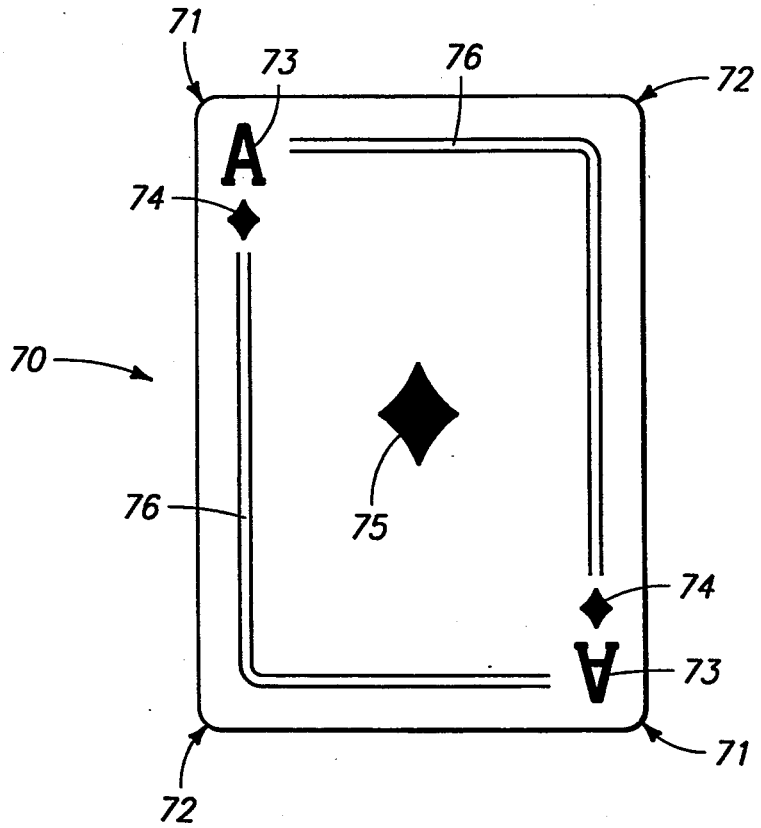

FIG. 7 shows a still further exemplary card 70 taken from deck 20. Card 70 is the ace of diamonds. The face of card 70 has card-specific primary indicia indicating the specific nature of the card as the ace of diamonds. The card-specific primary indicia is contained within a diagonal band extending between the opposing primary corners 71. The diagonal band of card-specific primary indicia includes alphabetical character indicators 73, which are the letter "A"; the suit indicators 74; and one diamond-shaped pip 75.

FIG. 7 also shows the characterizing secondary indicia used to indicate a member of the second group or subset of cards used to make a blackjack hand; specifically, the aces. The secondary corners 72 are distinctive of members of the subset forming a part of deck 20. Deck 20 includes a second subset having the four aces of the four common card suits. The secondary indicia are preferably secondary corner ace indicia provided in the secondary corners 72. The secondary corner indicia are distinctive of blackjack hand cards, as compared to other secondary corners of all non-ace cards in deck 20. As shown, distinctive secondary indicia 76 are perimeter corner markings contained in the opposing secondary corners 72. Secondary indicia 76 are perimeter lines drawn adjacent to the perimeter edges of the secondary corners 72. The perimeter indicia lines are most preferably dual lines which extend across both the long and short edges adjacent to the secondary corners.

Figure 8:
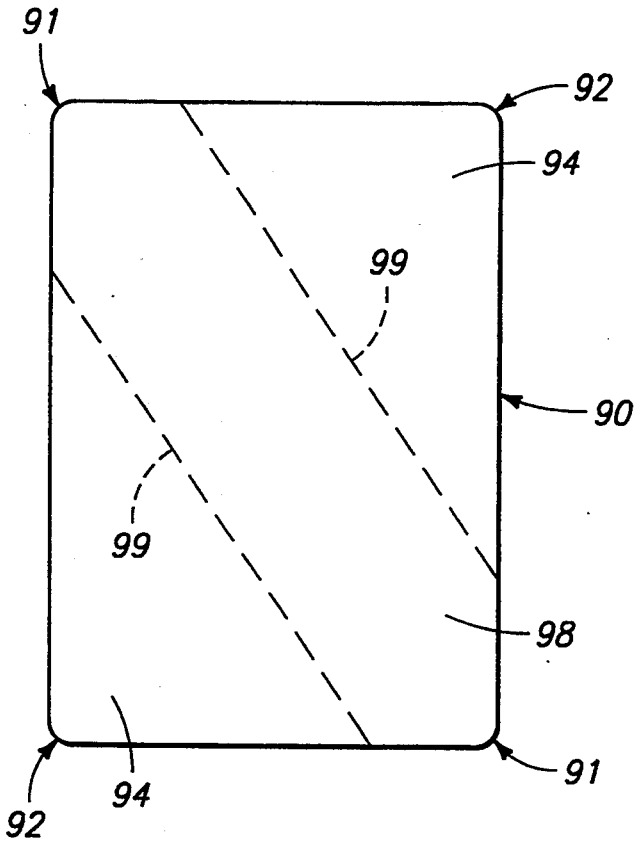
FIG. 8 is a diagrammatic face view illustrating cards contained in a first group of cards forming a part of a preferred card deck according to this invention.

FIG. 8 shows a schematic illustration of a first subset card 90 exemplifying a first subset or primary group of cards forming a part of deck 20. Members of this first subset include cards 40, 50 and 60 described hereinabove, and the remaining non-ace cards of deck 20. FIG. 8 shows a primary indicia zone 98. As shown, the primary indicia zone 98 is bounded by the primary corners 91 and adjacent portions of the short and long sides of the card. Diagonal primary zone boundaries 99 further serve to illustrate a preferred ambit of the primary indicia zone 98.

FIG. 8 also shows secondary indicia zones 94 which approximate the secondary corners 92. The secondary indicia zones 94 lie between the diagonal boundaries 99 and the edges of the card.

Figure 9:
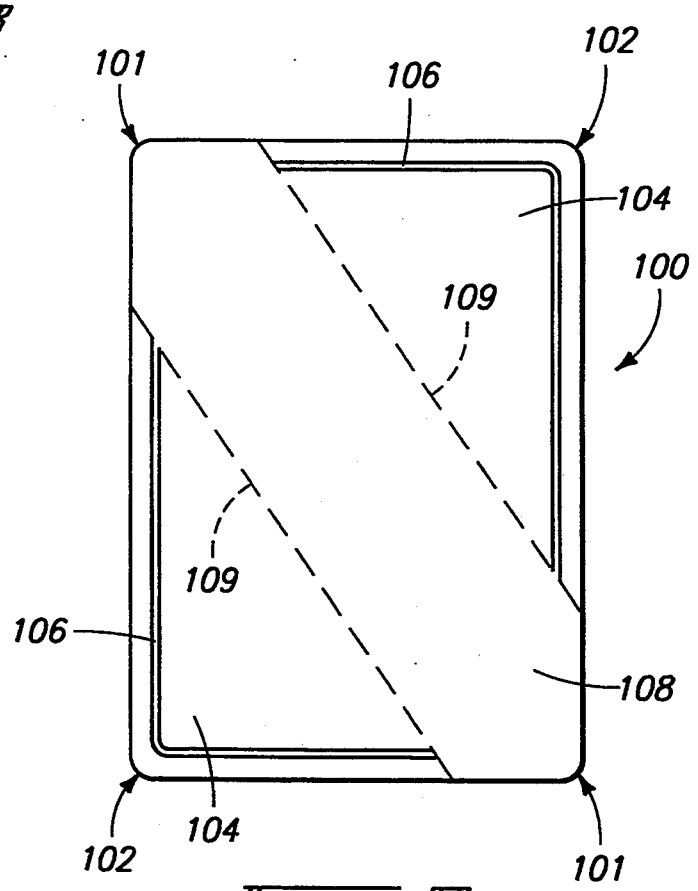
FIG. 9 is a diagrammatic face view illustrating cards contained in a second group of cards forming a part of a preferred card deck according to this invention.

FIG. 9 shows another schematic illustration of a second subset card 100 exemplifying a second group or subset of cards forming a part of deck 20. The secondary group is exemplified by ace 70 of FIG. 7. The second subset is complementary to the first subset in that the members of the first and second subsets together comprise the entire deck. Card 100 has a primary indicia zone 108. The primary indicia zone 108 is bounded by the primary corners 101 and adjacent portions of the short and long sides of the card. Diagonal primary zone boundaries 109 further serve to illustrate the boundaries of the primary indicia zone 108.

Card 100 also has secondary indicia zones 104. Contained within the secondary indicia zones are secondary indicia 106, advantageously in the form of dual marginal lines adjacent to the short and long edges within the diagonally opposing secondary corners 102.

Figure 10:
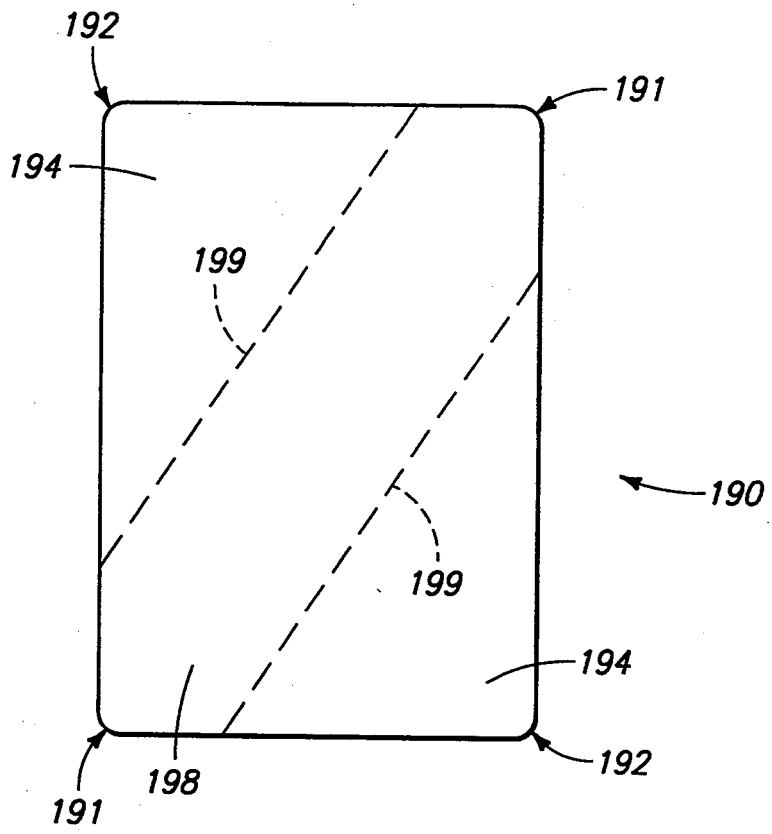
FIG. 10 is a diagrammatic face view illustrating cards contained in a first group of cards forming a part of a second alternative preferred card deck according to this invention.
Figure 11:
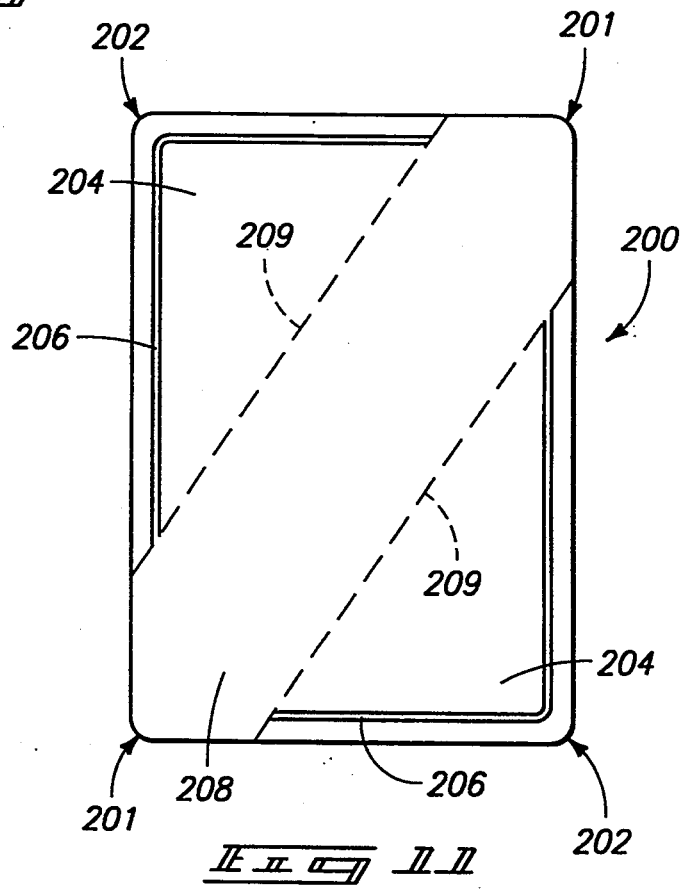
FIG. 11 is a diagrammatic face view illustrating cards contained in a second group of cards forming a part of the second preferred card deck according to this invention.

FIGS. 10 and 11 show schematic cards 190 and 200 which are analogous to the first and second subset cards 90 and 100. Corresponding numbering has been used to indicate the similar features except that the leading 9 has been changed to a leading 19, for example 94 corresponds to 194. Similarly for FIG. 11, 200 numbers correspond to 100 numbers. The relative relationships of the primary and secondary corners is inverted in cards 190 and 200.

The primary indicia zones are preferably sized to cover approximately 30–70 percent of the face area of the cards. Conversely, the secondary indicia zones are preferably sized to approximately cover a complementary 70–30 percent of the face area of the cards.

This invention further includes novel methods for playing the card game alternatively known as blackjack or twenty-one. The game includes play by at least one player and one dealer. The methods include dealing two cards to each player and the dealer. The players' cards are both typically dealt either faceup or facedown. In the case of the dealer, one card is dealt faceup and the other card is dealt facedown. The dealer then performs by considering whether the dealer can have a total hand count of twenty-one based upon the count of the faceup card. If there is a possibility of the dealer having a blackjack hand, then the dealer selectively peeks at a secondary corner of the face-down card to view illustrative portions of the secondary indicia zone contained thereon. The dealer performs by lifting a secondary corner to allow peeking and thereby enabling direct viewing. This direct viewing allows the dealer to determine whether the secondary corner includes a distinctive visually perceivable secondary indicia indicating the face-down card is a member of a secondary group or subset which provides a blackjack hand to the dealer. If so, then the dealer proceeds by ending play of the hand and declaring the dealer the winner. The dealer does not win against a player who also has a blackjack hand. Alternatively, if the dealer peeks to visually determine that the face-down card is a member of a primary group or subset which does not have distinctive secondary indicia and does not provide a blackjack hand, then the dealer performs by continuing play to the other player or players.

In preferred methods of this invention, the dealer checks for a blackjack hand when an ace is up by inspecting the primary indicia of the hole card. The ace up situation is less frequent than having a ten-count card faceup.

Knowledge of the hole card value when an ace is the dealer's upcard is of much less potential damage to the casino. This is true because players cannot use this information to gain a significant statistical advantage.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A playing card deck, comprising:

a series of cards each having a face and a back; said series of cards being organized into four playing suits with thirteen cards in each suit;

the faces of said cards having specific indicia thereon said specific indicia being distinctive to indicate the specific numerical count of the card;

specific indicia distinctively indicating the numerical count of the card being located only within an indicia band except as specified below, said indicia band comprising a surface area of the card face which extends between two diagonally opposing primary corners;

the faces of the cards also including two diagonally opposing secondary corners; said secondary corners for each card comprising the remaining surface area outside said indicia band which comprises at least 30 percent of the surface area of the card faces; the secondary corners of the various cards of the deck being non-distinctive of the count of the card, except for a subset of said cards forming a part of the deck which include one or more subset class members; said subset class members having a class symbol indicating membership in the subset which is presented in the secondary corners of the subset class members; said class symbol being indicative of aces.

2. A playing card deck according to claim 1 wherein said indicia band extends between two diagonally opposing primary corners.

3. A playing card deck according to claim 1 wherein said indicia band covers approximately 30 to 70 percent of the faces of the cards.

4. A playing card deck according to claim 1 wherein the class symbol is at least one perimeter line.

5. A playing card deck according to claim 1 wherein the class symbol is a dual perimeter line.

6. A playing card deck according to claim 1 wherein the class symbol includes a dual perimeter line.

7. A playing card deck according to claim 1 wherein the indicia band includes indicia pips which are arranged in diagonal arrangement.

8. A playing card deck according to claim 1 wherein the indicia band extends between two diagonally opposing primary corners, and further comprising indicia characters and suit indicators in said primary corners.

9. A method for playing the card game blackjack or casino twenty-one involving at least one dealer and at least one player, comprising:

selecting at least one blackjack deck of cards having:

a series of cards each having a face and a back;

the faces of said cards each having specific indicia thereon, said specific indicia being distinctive to indicate the numerical count of the card;

specific indicia distinctively indicating the numerical count of the card being located only within a diagonal indicia band which extends between two diagonally opposing primary corners;

the faces of the cards also including two diagonally opposing secondary corners; said secondary corners for each card comprising the remaining surface area outside said indicia band which comprises at least 30 percent of the surface area of the card faces; the secondary corners of the various cards of the deck being non-distinctive of the count of the card, except for a subset of said cards forming a part of the deck which include one or more subset class members; said subset class members having a class symbol indicating membership in the subset which is presented in the secondary corners of the subset class members;

dealing two cards to each player and the dealer, the cards to the dealer being one facedown and one faceup card;

considering whether the dealer can have a total hand count of twenty-one based upon the count of the faceup card of the dealer;

lifting a secondary corner of said facedown card of the dealer;

peeking by directly viewing the secondary corner of the dealer facedown card which has been lifted to see if the card is either non-distinctive in the secondary corner or is a member of a subset class which produces a dealer total hand count of twenty-one;

ending the play of a hand of cards if the dealer total hand count equals twenty-one after the dealer has only received two cards.

10. A method according to claim 9 wherein the subset class members are cards forming part of a blackjack hand.

11. A method according to claim 9 wherein the subset class members are aces.

12. A playing card deck for playing the card game of blackjack, comprising:

a series of cards each having a face and a back; said series of cards being organized into four playing suits with thirteen cards in each suit with names ace, two, three, four, five, six, seven, eight, nine, ten, jack, queen, and king;

the faces of said cards each having indicia thereon to indicate the suit and count of the card; said indicia including specific indicia which are distinctive of the numerical count of the card;

said specific indicia being located only within a diagonal indicia band except as specified below, said indicia band comprising a surface area of the card face which extends between two diagonally opposing primary corners; said indicia band covering approximately 30 to 70 percent of the faces of the cards;

the faces of the cards also including two diagonally opposing secondary corners; said secondary corners for each card comprising the remaining surface area outside said indicia band which comprises at least 30 percent of the surface area of the card faces; the secondary corners of the various cards of the deck being non-distinctive of the count of the card, except for an ace subset of said cards which includes only the aces of all suits; said ace subset class members having an ace class symbol indicating membership in the ace subset which is presented in the secondary corners of the subset class members.

13. A playing card deck according to claim 12 wherein the class symbol is at least one perimeter line.

14. A playing card deck according to claim 12 wherein the class symbol is a dual perimeter line.

15. A method for playing the card game blackjack or casino twenty-one involving at least one dealer and at least one player, comprising:

selecting at least one blackjack deck of cards having:

a series of cards each having a face and a back; said series of cards being organized into four playing suits with thirteen cards in each suit with names ace, two, three, four, five, six, seven, eight, nine, ten, jack, queen, and king;

the faces of said cards each having indicia thereon to indicate the suit and count of the card; said indicia including specific indicia which are distinctive of the numerical count of the card;

said specific indicia indicating the numerical count of the card being located only within a diagonal indicia band, except as specified below, said indicia band comprising a surface area of the card face which extends between two diagonally opposing primary corners;

the faces of the cards also including two diagonally opposing secondary corners; said secondary corners for each card comprising the remaining surface area outside said indicia band which comprises at least 30 percent of the surface area of the card faces; the secondary corners of the various cards of the deck being non-distinctive of the count of the card, except for a subset of said cards forming a part of the deck which include one or more subset class members; said subset class members having a class symbol indicating membership in the subset which is presented in the secondary corners of the subset class members;

dealing two cards to each player and the dealer, the cards to the dealer being one facedown card and one faceup card;

determining whether the dealer has a faceup card with a count of ten;

lifting a secondary corner of said facedown card of the dealer to an extent not extending beyond secondary corner boundary;

peeking by directly viewing the secondary corner of the dealer facedown card which has been lifted to see if the card is an ace which provides a dealer total hand count of twenty-one;

ending the play of a hand of cards if the dealer total hand count equals twenty-one after the dealer has only received two cards.

* * * * *